US006672496B2

(12) United States Patent
Caster

(10) Patent No.: US 6,672,496 B2
(45) Date of Patent: Jan. 6, 2004

(54) DERELICT PRODUCT CRACKER, NEST, AND CRACKING METHOD

(75) Inventor: Gilbert E. Caster, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 65 days.

(21) Appl. No.: 10/117,897

(22) Filed: Apr. 8, 2002

(65) Prior Publication Data

US 2003/0188642 A1 Oct. 9, 2003

(51) Int. Cl.[7] ..... B26F 3/04; B26F 3/00

(52) U.S. Cl. ..... 225/1; 225/3; 225/103; 29/426.1; 29/426.3; 29/426.5

(58) Field of Search ..... 29/402.03, 403.1, 29/426.1, 426.3, 426.4, 426.5, 592.1; 206/316.2; 414/400; 72/412; 225/103, 104, 105, 1, 3; 100/35

(56) References Cited

U.S. PATENT DOCUMENTS 3,722,768 A * 3/1973 Schnellmann ..... 225/105
3,819,096 A * 6/1974 Pyper ..... 225/96.5
4,208,116 A * 6/1980 Morse ..... 396/512
4,343,287 A * 8/1982 Hallberg et al. ..... 125/23.01
4,473,192 A * 9/1984 Urban et al. ..... 241/168
4,793,248 A * 12/1988 Frederiksen et al. ..... 99/575
5,103,721 A 4/1992 Chou et al.
5,217,171 A 6/1993 Feldman
5,333,542 A 8/1994 Lewis et al.
5,649,236 A 7/1997 Balling
5,678,775 A 10/1997 Chapman
5,682,571 A 10/1997 Balling
5,735,933 A 4/1998 Yokoyama et al.
5,788,167 A 8/1998 Chapman
5,887,805 A 3/1999 Chapman
5,906,143 A * 5/1999 Yuen ..... 81/3.39
6,164,571 A 12/2000 Kovalak et al.
6,223,736 B1 * 5/2001 Yasuga ..... 125/23.02
6,240,914 B1 * 6/2001 Yasuga ..... 125/23.02
6,300,402 B1 10/2001 Chapman
6,308,877 B1 * 10/2001 Lihl et al. ..... 225/2
6,457,621 B1 * 10/2002 Hahnel et al. ..... 225/103

* cited by examiner

*Primary Examiner*—Allan N. Shoap
*Assistant Examiner*—John Windmuller
(74) *Attorney, Agent, or Firm*—Robert Luke Walker

(57) ABSTRACT

A method, product cracker, and nest are used with a derelict product having a shell covering a core. The shell has opposed front and rear faces and a sidewall having at least one pair of diagonally opposed corner-edges extending transversely between the faces, and is separable along the sidewall into a pair of covers. In the method, the front and rear faces of the product are placed in alignment with a first axis and the pair of diagonally opposed corner-edges are placed in alignment with a second axis perpendicular to the first axis. The shell is directly supported near one corner-edge of the pair of diagonally opposed corner-edges and is impacted at the other corner-edge with sufficient force to separate the covers. The alignments are maintained during the impacting. The covers and core are collected and the core is sorted out.

14 Claims, 11 Drawing Sheets

DERELICT PRODUCT CRACKER, NEST, AND CRACKING METHOD

FIELD OF THE INVENTION

The invention relates to equipment for recycling and disposal of used equipment, particularly consumer electronics and one-time-use cameras and more particularly relates to a derelict product cracker, cracker nest and method.

BACKGROUND OF THE INVENTION

In some industries, manufacturers receive back from consumers, a stream of used products (also referred to herein as "derelict products") for recycling or appropriate disposal. Some legislative efforts have been directed toward mandating this approach for many consumer products. The returned products are often restored for consumer reuse. One-time-use cameras are recycled in this manner. The returned products can, alternatively, be recycled as raw material feedstocks or otherwise disposed of in a suitable manner.

Although it is preferred that returned products received are restored for later reuse, even under optimal conditions, not all post-consumer products received back in a post-consumer used products stream can be restored for reuse. Some returned products are excessively damaged for reuse. Other products may be modified in a manner that makes restoration impossible or impractical. The result is that at least a portion of the stream of returned products must be disposed of, preferably by reuse of as many parts as possible as chemical feedstocks and disposal of any residue in sanitary landfill or the like.

One type of approach to disposing of such products is crushing the products into small fragments and then separating the fragments. U.S. Pat. No. 6,300,402 discloses a method in which an electrical product is crushed repeatedly and air separators are then used to remove nonmetallic lightweight materials from heavier fragments. U.S. Pat. No. 5,217,171 discloses a method in which equipment is mechanically crushed to provide a mixture of particles, which are then subject to mechanical concentration by use of hydrocyclone, followed by recleaning, magnetic separation, and hydrometallurgical processing. U.S. Pat. No. 6,164,571 discloses a method for separating metals from thermoset plastics using high temperature and pressure and a solvent. U.S. Pat. No. 5,735,933 discloses a method involving crushing, screening by size of particle, heating to high temperatures, and then recovering metal and nonmetal vapors. These approaches can be effective, but are also energy intensive and difficult.

U.S. Pat. No. 5,103,721 discloses a simpler approach suitable for aluminum cans. The empty cans are stood, one at a time, in a chamber and to the top and bottom of the chamber are brought together squeezing the cans flat. The crushed cans are used as raw material feedstock. U.S. Pat. No. 5,333,542 discloses another apparatus in which aluminum cans are aligned, one at a time, and crushed from side-to-side rather than top-to-bottom. These approaches are simple, straightforward, and, in one form or another, widely used for simple products.

Common one-time-use cameras have a shell that covers and must be separated from an internal core for recycling. The shell generally has a pair of covers joined together along a longitudinal scene. A chassis, internal to the covers, provides additional structural support and other features. The separable core is typicaly a circuit board that can be part of the chassis or included with the chassis inside the shell.

One-time-use cameras are recycled by camera manufacturers by careful disassembly followed by testing and reuse of some parts, use of other parts for chemical feedstocks, and disposal of a small fraction of the camera parts. This approach is labor-intensive, but can be automated for returned products having uniform characteristics. Other returned products preclude automation due to damage or non-uniform characteristics.

Another approach to camera recycling, described in the U.S. Pat. Nos. 5,649,236 and 5,682,571, involves impacting the edge of the camera body against the edge of a table to effectively crack the camera open. This approach has sometimes been used during removal of exposed film from one-time-use cameras. The impacting on the table edge tends to cause major damage to internal components, which can include fragmenting of internal electrical components such as circuit boards. Similar results are seen if the cameras are compressed from side-to-side or end-to-end. The result is that much manual sorting is required to separate components and fragments and that it is more efficient to carefully open the cameras rather than crack them in this manner. Similar approaches to recycling raise similar issues for other manufactured products built with a core and shell structure. Examples of such products include most handheld consumer electronics, such as cellular telephones, audio players, calculators, and the like. A great many of these products are similar to common one-time-use cameras in another way; internal components are held together by the shell and will readily separating when the shell is removed.

It would thus be desirable to provide an improved cracking method, cracker, and cracker component in which a product shell is removed with a reduced risk of damage to or fragmentation of internal components of the product.

SUMMARY OF THE INVENTION

The invention is defined by the claims. The invention, in its broader aspects, provides a method, product cracker, and nest that are used with a derelict product having a shell covering a core. The shell has opposed front and rear faces and a sidewall having at least one pair of diagonally opposed corner-edges extending transversely between the faces, and is separable along the sidewall into a pair of covers. In the method, the front and rear faces of the product are placed in alignment with a first axis and the pair of diagonally opposed corner-edges are placed in alignment with a second axis perpendicular to the first axis. The shell is directly supported near one corner-edge of the pair of diagonally opposed corner-edges and is impacted at the other corner-edge with sufficient force to separate the covers. The alignments are maintained during the impacting. The covers and core are collected and the core is sorted out.

It is an advantageous effect of the invention that an improved cracking method, cracker, and cracker component are provided in which a product shell is separated with a reduced risk of damage to or fragmentation of internal components of the product.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying figures wherein.

DETAILED DESCRIPTION OF THE INVENTION

Referring now particularly to FIGS. 1–4, the derelict product cracker 10 has a nest 12 and a ram 14 disposed over the nest 12. The ram 14 is movable reciprocally between a far position removed from the nest 12 and a near position closer to the nest 12 to crack derelict products 16.

Figure 9:
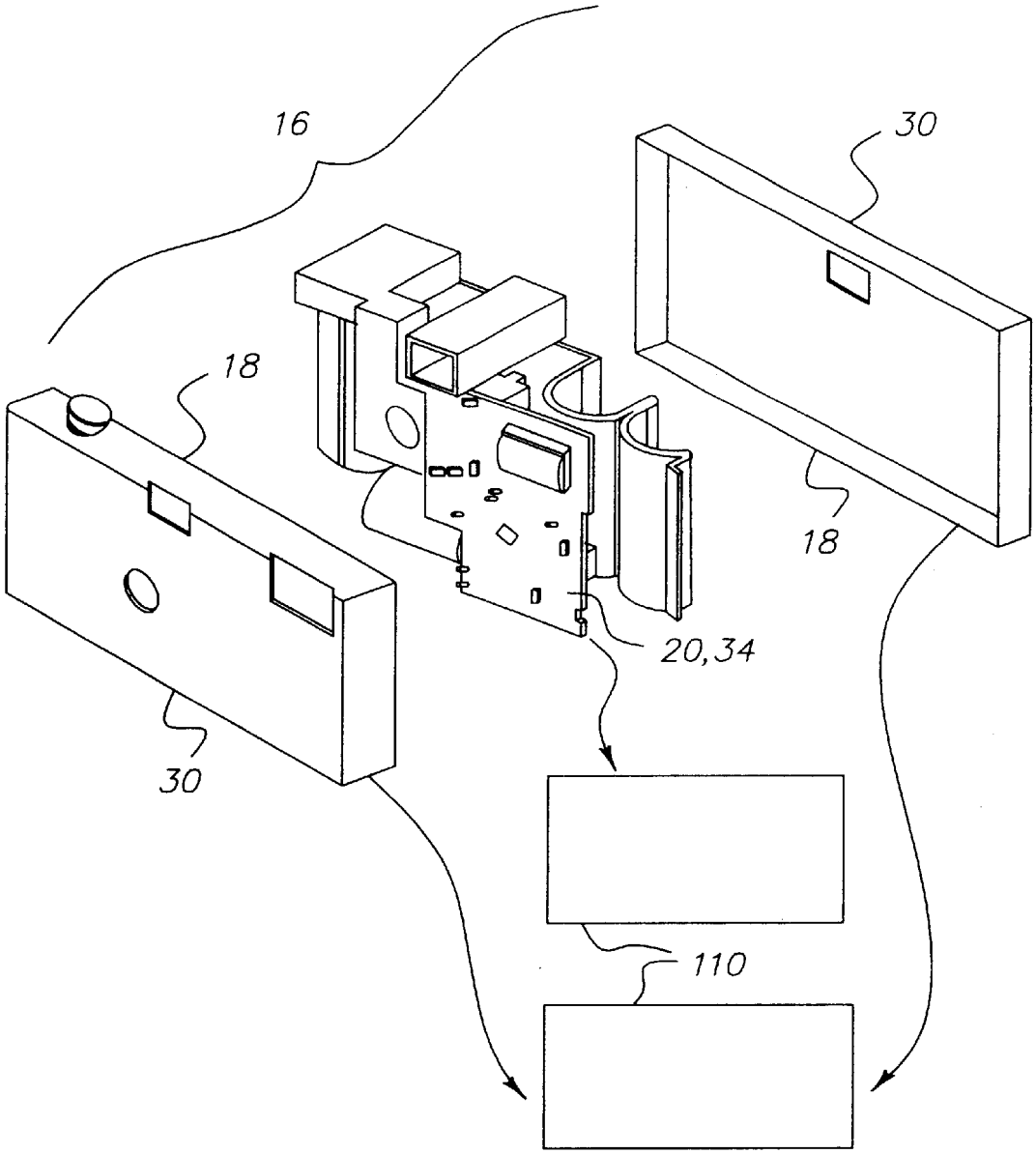
FIG. 9 is a semi-diagrammatical view of the camera of FIG. 8 after cracking and of a sorting step applicable to the method shown in FIG. 7.

The derelict product cracker 10, cracker nest 12, and method are used with derelict products 16 having a shell 18 covering a core 20 and are particularly suitable for derelict products 16 having the general configuration shown in FIG. 9. The shell 18 has opposed front and rear faces 22,24 and a sidewall 26 extending between the faces 22,24. The sidewall 26 has at least one pair of diagonally opposed corner-edges 28 extending transversely between the faces 22,24. The corner-edges 28 can be sharp or very rounded or anything in between or of a more complex shape. The shell 18 is separable along the sidewall 26 into a pair of covers 30. Each cover 30 includes one of the faces 22,24 and a part of the sidewall 26. The sidewall 26 can divide along a midline 32, as shown in FIG. 9, or unequally, or in a more complex manner. The shell 18 has a maximum dimension in a longitudinal direction and a minimum dimension in a depth direction. The core 20 of the derelict product 16 is a part that needs to be separated out, such as a circuit board 34, or battery (not shown), or both. Other internal parts such as an internal plastic frame can be treated as part of the core or part of the shell as appropriate. The shell 18 can be held in place in any of a wide variety of ways, such as fasteners, adhesive, sonic welding, and integral clips. Cracking breaks or releases the holding means or breaks the shell.

Referring again to FIGS. 1–4, in the illustrated embodiments, the nest 12 and ram 14 are held within an enclosure having a frame 36 and panels (not shown) mounted over the frame 36. The frame 36 can have movable doors (not shown) for entry and exit of derelict products 16 and access to internal features. Features of the frame 36 are not critical and can be varied to meet the requirements of a particular use.

Referring now to FIGS. 3–6, the cracker nest 12 has a V-block 38, which holds the derelict product 16 for cracking. The V-block 38 has a datum structure 40, which defines a nest axis 42. It is convenient if the datum structure 40 is held in immobile relationship to a mount (not separately illustrated) for joining the V-block 38 to a structural support. The datum structure 40 can be part of the mount or can be separate, but has a known geometric relationship to the mount. For example, in the embodiment shown in the figures, the datum structure 40 is the flat bottom of the V-block 38 and the nest axis 42 is perpendicular to the flat bottom. The mount is a fastening structure, such as tapped holes in the flat bottom of the V-block. The frame 36 has a horizontal table 44 and the bottom is held against the table 44 by fasteners, such as bolts (not shown) engaging tapped holes in the V-block 38. The bottom of the mounted V-block 38 is horizontal and the nest axis 42 is vertical. For greater robustness, the geometric relationship of the datum structure 40 to the nest axis 42 can be unchangeable, absent remanufacture of the parts. This is the case with the V-block 38 shown. Adjusters, such as shims or the like can, alternatively, be provided if desired.

The V-block 38 has a side support 46 and an end support 48. The supports 46,48 are named after parts of a derelict product 16 for which the respective supports 46,48 provide a support function. The defective product 16 has two pair of opposed sides 50 (the faces and the top and bottom) and a pair of opposed ends 52. One side 50 contacts the side support 46 and an end 52 contacts the end support 48 when the derelict product 16 is in the nest 12. The nests shown in FIGS. 1–6 have a V-block 38 that is a solid piece of steel and the supports 46,48 are each continuous with the base 54 of the V-block 38. This construction is highly resistant to wear and damage. The V-block 38 can, alternatively, be provided as an assembly of multiple pieces, if such robustness is not required for a particular use.

Figure 1:
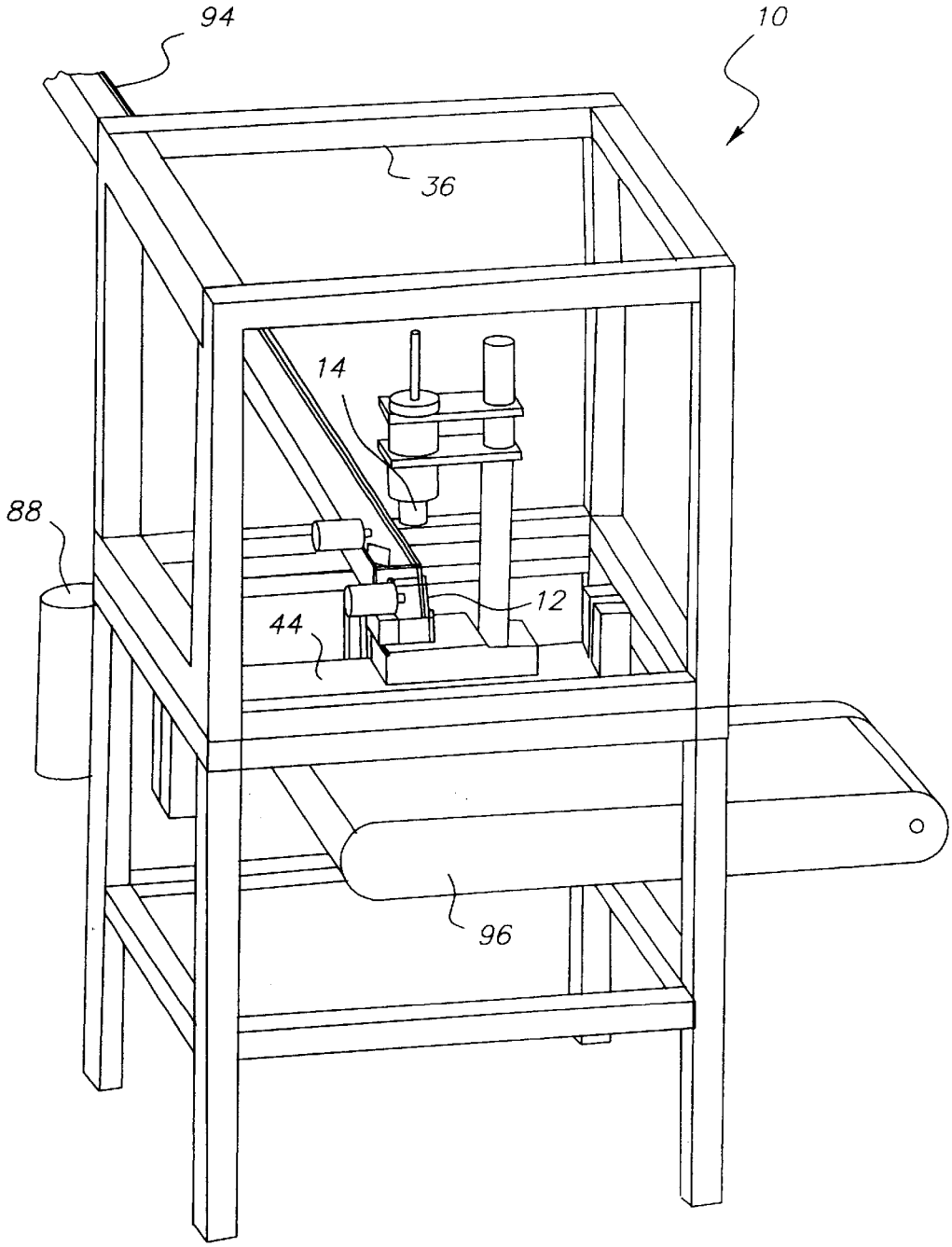
FIG. 1 is a perspective view of an embodiment of the derelict product cracker.
Figure 2:
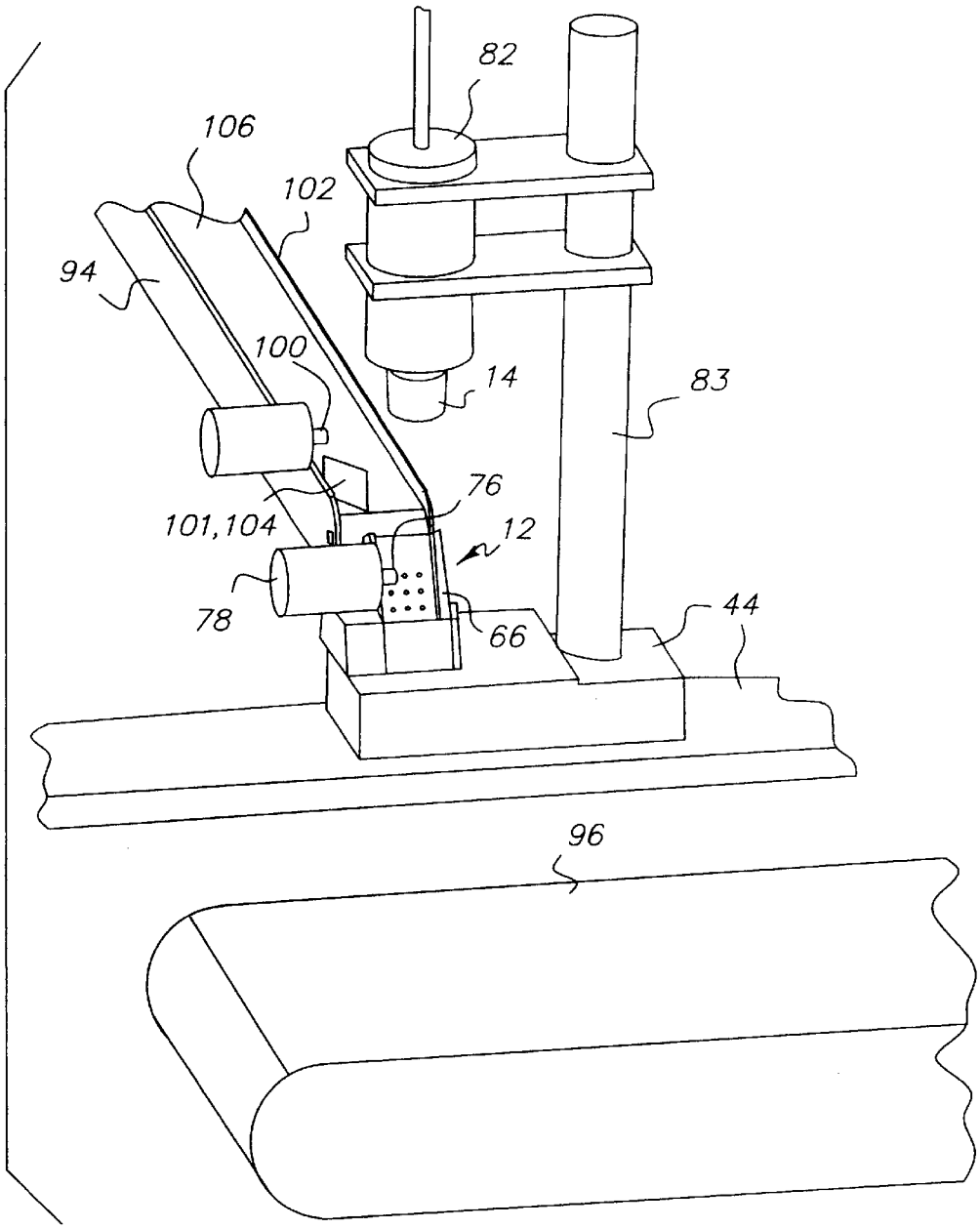
FIG. 2 is a partial enlargement of the view of FIG. 1, with some frame components deleted.
Figure 3:
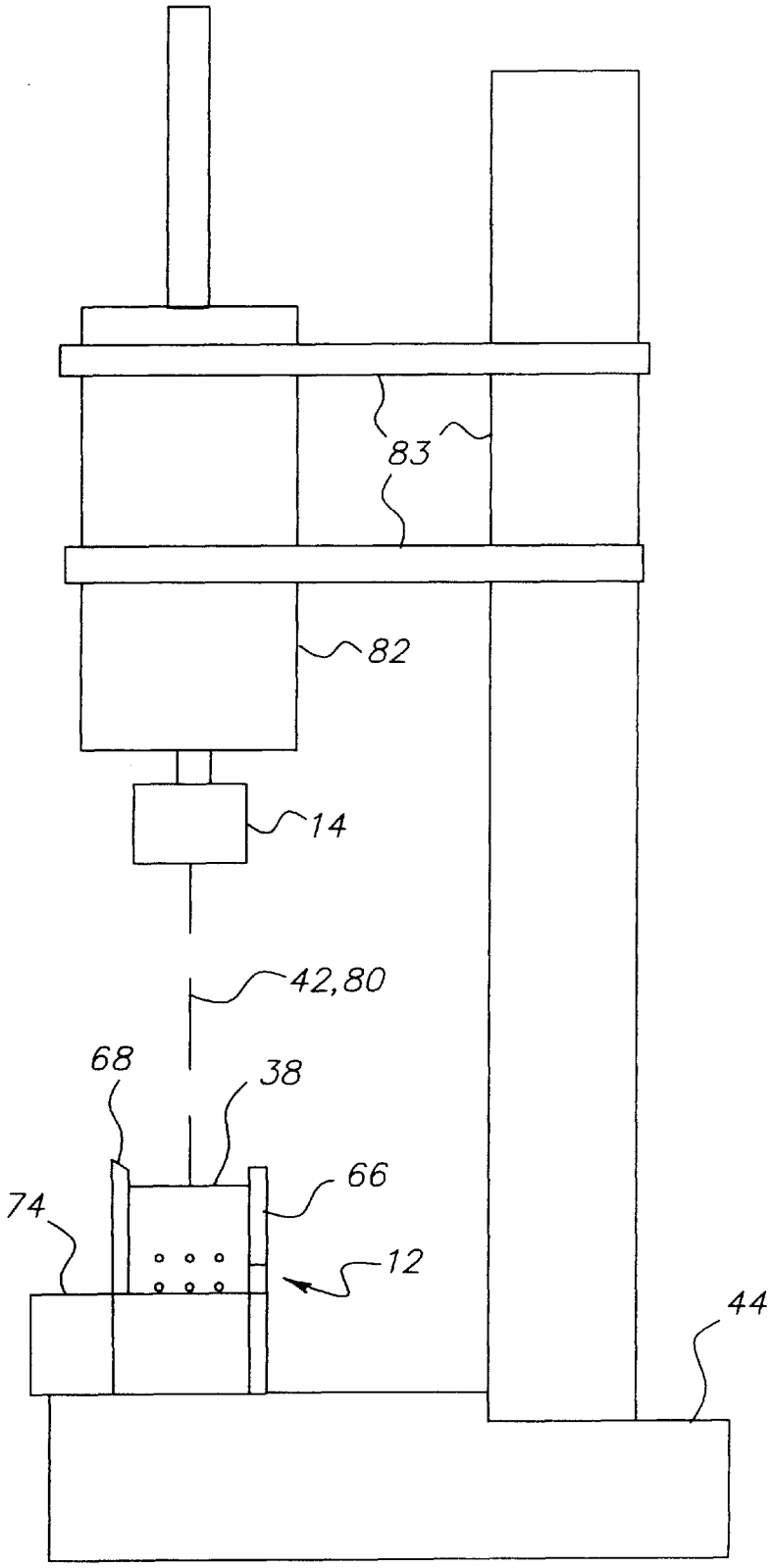
FIG. 3 is a front view of the cracker nest, ram, ram driver, and associated frame components of the cracker of FIG. 1. The ram is in the far position.
Figure 4:
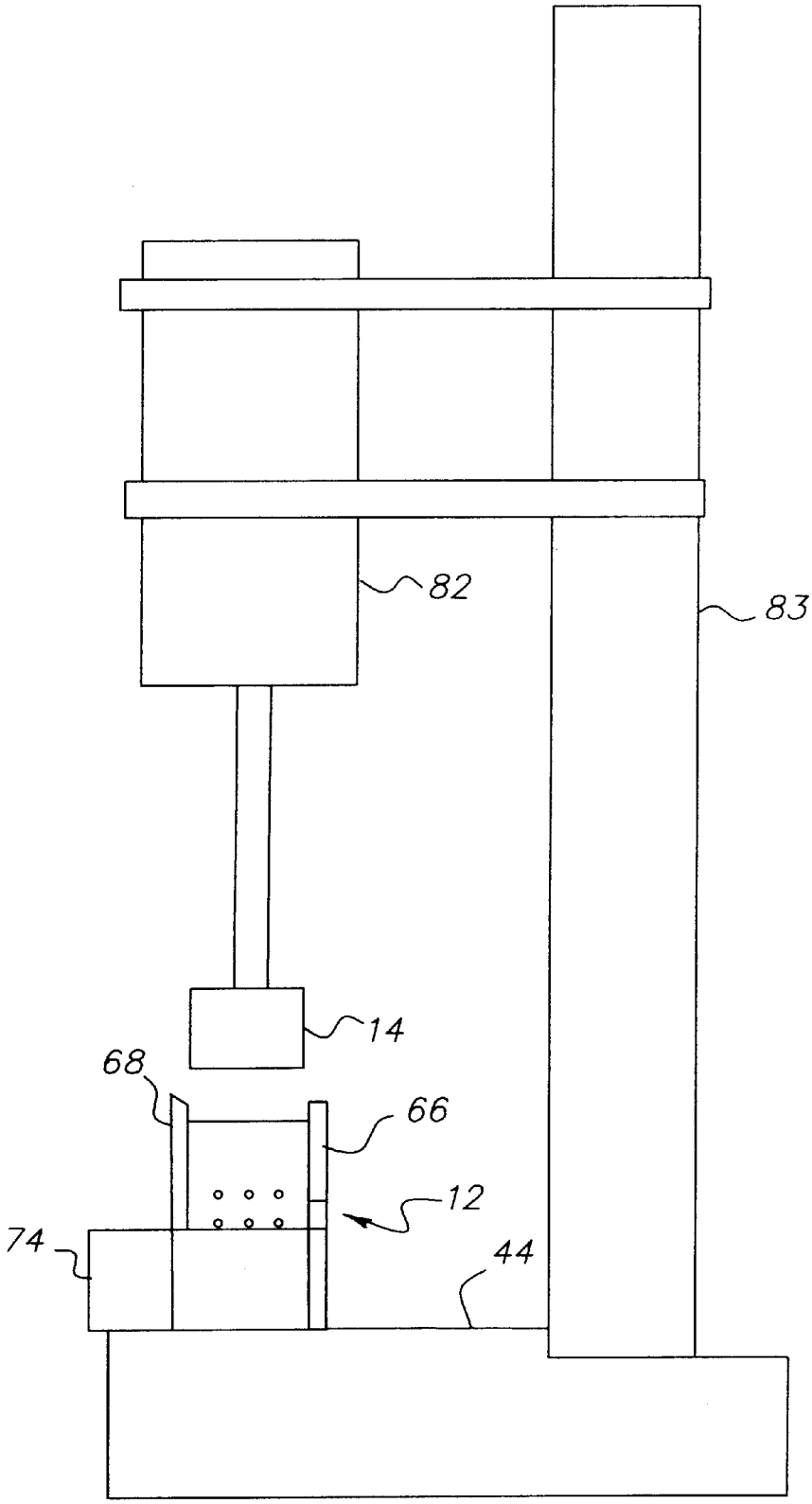
FIG. 4 is the same view as FIG. 3, but the ram is in the near position.
Figure 5:
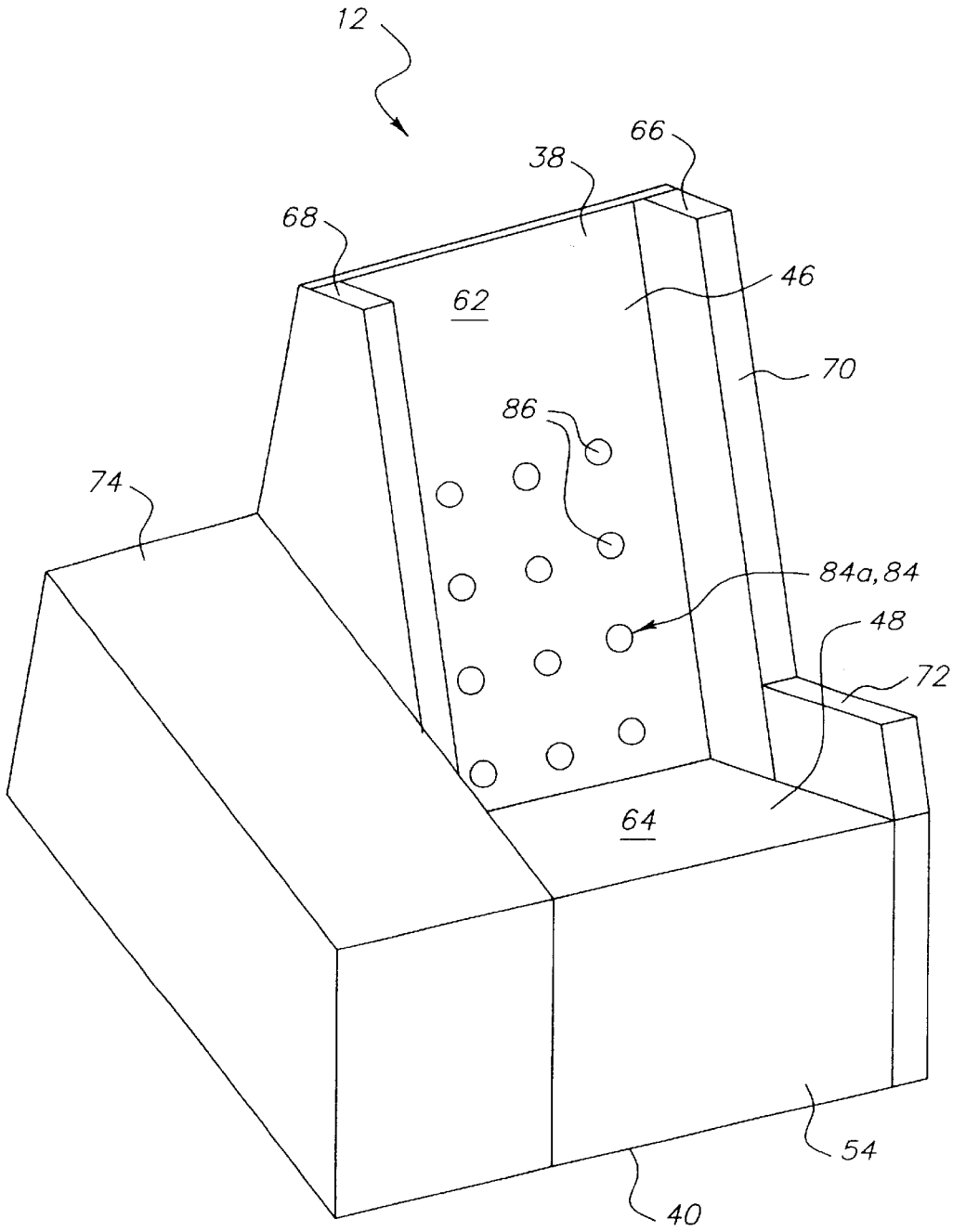
FIG. 5 is a perspective view of the nest of the cracker of FIG. 1.

The side support 46 and end support 48 define intersecting side support and end support planes 56,58, respectively. The planes 56,58 are indicated in FIG. 3 by dashed lines. Each plane 56,58 is inclined relative to the nest axis 42 and the nest axis 42 intersects the line of intersection of the side support plane 56 and end support plane 58. The supports 46,48 define a transverse axis 60 (indicated by a circle in FIG. 6) which follows the line of intersection of the planes 56,58 and is perpendicular to the nest axis 42. In the illustrated embodiments, the side support plane 56 and end support plane 58 are each inclined at a different angle relative to the nest axis 42 and the end support plane 58 is inclined at about double the angle of the side support plane 56. The planes 56,58 can both be inclined at the same angle relative to the nest axis 42, but such a cracker 10 is optimal for a more limited range of shapes of derelict products 16, generally those having similar length and width dimensions.

Figure 6:
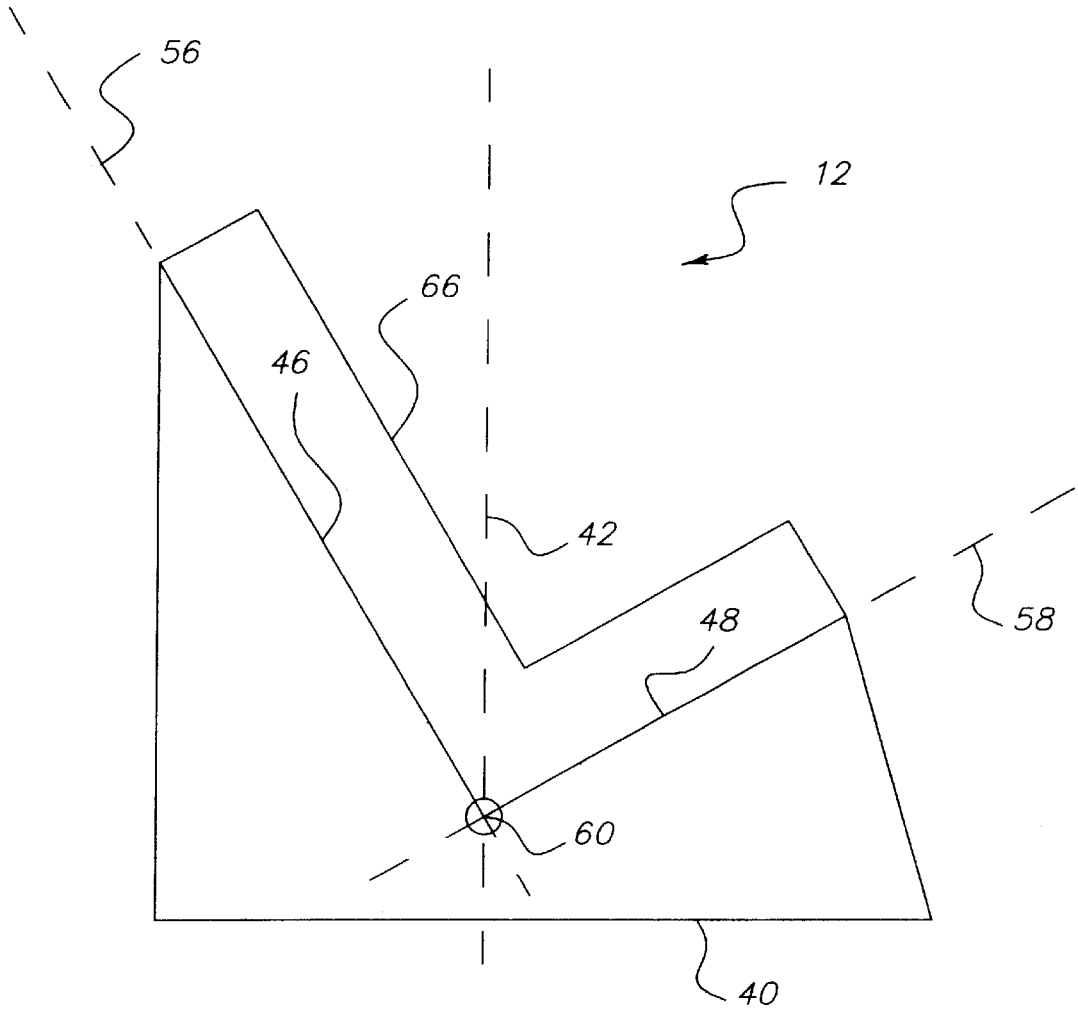
FIG. 6 is a semi-diagrammatical cross-sectional view of the nest of FIG. 5.

Referring now to FIG. 6, in the embodiment shown in the figures, the two planes 56,58 come together at an angle of about 90 degrees, that is, 90±1 degree. This angle can be increased or decreased by 10 degrees or even 20 degrees, however, these changes can degrade performance of the cracker 10 with particular configurations of derelict product 16. In a plane (defined in FIG. 6 by the page) parallel to the nest axis 42 and perpendicular to the line of intersection of the side support and end support planes 56,58, the side support 46 is disposed at an angle of about 30 degrees (30±1 degrees) to the nest axis 42 and the end support 48 is disposed at an angle of about 60 degrees (60±1) to the nest axis 42. These two angles can each be increased or decreased by 5 degrees or even 10 degrees, within the limitations of the overall angle between the side support and end support planes 56,58 and subject to performance limitations, as earlier discussed.

The size of the V-block 38 can be varied to meet the requirements of a particular derelict product stream. For example, a V-block 38 can be scaled for use with commonly available one-time-use cameras. Such cameras can be defined as having a length of between 10 and 13 cm, a width between 2 and 4 cm and a depth between 5 and 7 cm. In this case, a suitable outward dimension for the side support 46 in a direction perpendicular to the transverse axis 60 (the direction corresponding to the camera length) is 8+0/−0.5 cm. A suitable outward dimension for the end support 48 in a direction perpendicular to the transverse axis 60 (the direction corresponding to the camera width) is 5–5.1±0.5 cm. A suitable crossways dimension for both supports 46,48 in directions parallel to the transverse axis 60 is 4±0.5 cm. Longer outward dimensions tends to make the cameras more resistant to cracking. A longer outward dimension of the side support 46 tends to make the cameras more subject to bouncing and improper positioning during loading. A shorter outward dimension of the end support 48 tends to cause the cameras to fall out. A greater depth leads to more mispositioning of smaller cameras in the range. (In use, derelict products can be limited to those that meet particular defined dimensions by sorting non-conforming products out of the product stream prior to cracking.)

In the embodiments shown in the figures, the outward dimension of the side support 46 is larger than the outward dimension of the end support 48 by a ratio of about 3:2. The side support 46 has an outward dimension that is less than the mean average longitudinal dimension of the defined derelict product (that is, the average size product 16 for which the particular cracker 10 is intended). In the embodiments shown in the figures, the outward dimension of the side support 46 is shorter than the mean longitudinal dimension of the defined derelict product by a ratio of 3:4.2 to 3:5. The outward dimension of the end support 48 is related to the width dimension of the product 16 by a ratio of 2:1.9 to 2:2.7.

The surfaces 62,64 of the supports 46,48 can be solid or can be perforated or relieved or textured in some manner. These changes are unimportant as long as the required robustness of the nest 12 is not compromised and the size and shape of the surface of each support is not reduced to the point that defective products 16 could lodge within perforations or other geometric features of the respective support. This effect is undesirable, since it degrades the positioning provided by the supports 46,48.

In the illustrated embodiments, the nest 12 has a bumper 66 laterally adjoining the supports 46,48. The bumper 66 blocks one direction of lateral movement of the derelict product 16 during cracking. In the embodiments shown, the bumper 66 is L-shaped and has an outward extension from the surfaces 62,64 that is much less than the outward or transverse dimensions of the supports 46,48. In an embodiment suitable for use with the one-time-use cameras earlier described, the outward dimension of the bumper 66 from the surface of the adjoining support 46 or 48 is a uniform 1.3 cm. A larger dimension than this tends to increase the resistance of the cameras to cracking.

A second bumper 68 can be provided on the other side of the supports 46,48. The second bumper 68 can have the same shape as the first bumper 66 or can be differently shaped. In the illustrated embodiments, the second bumper 68 has an upper portion 70 that is angled inward at about 30 degrees to help direct the derelict products 16 toward the first bumper 66. The second bumper 68 also has a lower portion 72 that is part of an auxiliary block 74 joined to the V-block 38. The auxiliary block 74 is optional and can be used to provide an attachment point for other parts. It is convenient to manufacture the first bumper, V-block, and auxiliary block as three separate parts and then to bolt them together utilizing tapped holes (not shown) in the auxiliary block.

In the illustrated embodiments, a clamp jaw 76 is provided opposite the bumper 66. The clamp jaw 76 is movable toward and away from the first bumper 66 over a range sufficient to accommodate the maximum and minimum depth dimensions of the derelict product 16. The clamp jaw 76 is driven by a clamp driver 78, such as an air cylinder or other linear motor that drives the clamp jaw 76 forward and back. The clamp jaw 76 can also be part of a mechanically operated clamp. The clamp jaw 76 moves linearly in the illustrated embodiments, but movement can be provided in another manner such as pivoting. The clamp jaw 76 holds a derelict product 16 in place against the first bumper 66 when the ram 14 impacts the derelict product 16. Movement of the clamp jaw 76 is synchronized to occur before the ram 14 is impacted against the product 16. The clamp jaw 76 can take the place of or be used in conjuction with the second bumper 66. The shape of the clamp jaw 76 can be varied to match the dimensions of expected derelict products.

The motion of the clamp jaw 76 toward the bumper 66 can be controlled by stalling the driver 78 or by use of a manual control (not shown) or with an automated system that stops jaw movement responsive to an increase in resistance encountered by the clamp driver 78 or the like. The clamp jaw 76 can start moving manually, or can automatically close when a derelict product 16 is detected, or on regular cycle. Opening of the clamp jaw 76 can be automatic or manual, in the same manner as the closing or different, following impacting of the ram 14 against the derelict product 16. Opening and closing of the clamp jaw 76 is synchronized with the operation of the ram 14.

The ram 14 is movable reciprocally between a close position near the V-block 38 of the nest 12 and a far position farther removed from the V-block 38. In the embodiments shown in the figures, the ram 14 moves linearly along a ram axis 80 that extends through the center of the ram 14. The ram axis 80 is parallel to or coextensive with the nest axis 42. The ram 14 is moved by a linear driver 82, such as an air cylinder or solenoid. The driver 82 is held by a holder 83 that is part of the frame 36. The driver 82 can move the ram 14 in both directions or, with a vertically mounted ram 14 of sufficiently weight, driven movement can be limited to raising the ram 14 and gravity can provide the impetus for the downstroke. The ram 14 is not limited to linear motion and can be pivoted between close and far positions about a pivot axis or can move in a more complicated manner. For example, the ram 14 can be the head of a triphammer. With such rams, the nest axis 42 extends through the ram 14 when the ram 14 is in the close position.

In the illustrated embodiment, the ram 14 moves rapidly from the far position to the close position, so as to impact rather than squeeze a derelict product 16 in the nest 12. This approach has the advantage of reduced cycle time. The cracker 10 can be modified to squeeze derelict products 16 if impacting results in excessive core 20 fragmentation. The force required to separate the covers 30 of the derelict product 16 can be initially estimated for a particular stream of derelict products 16 and then can be adjusted up or down based upon results. With the one-time-use cameras earlier discussed, a suitable impact force is 500 psi/3450 kpscl. A suitable stroke is 3 inches/7.6 cm, with the near position being at 2 and ⅞ inches/7.3 cm from the transverse axis 60.

The ram 14 is shaped so as to impact the derelict product 16 without puncturing through the shell 18 and is, preferably, also shaped so as to impact without applying a torque to the product 16 that could twist the product 16 during cracking. The ram 14 is therefore preferably blunt and uniform in shape about the ram axis 80. An example of a suitable shape is cylindrical. The suitable size, in a direction parallel to the transverse axis 60, is the same or larger than the transverse dimension of the supports 46,48, and thus equal to or larger than the depth of the expected derelict products 16. This size minimizes any possibility of puncture of the derelict product 16.

Reciprocation of the ram 14 can be controlled to occur only when the derelict product 16 occupies the nest 12 or, alternatively, reciprocation can be continuous. The former can be more energy-efficient. The latter can utilize a more simplified control system such as manual switches (not shown).

In the illustrated embodiments, the cracker 10 includes a sweep 84 that is operatively disposed to clear the V-block 38 after cracking is completed. Following cracking, the cracked product 16 may or may not tend to fall from the nest 12. The use of the sweep 84 removes the product 16 or any residue from the nest 12 that could otherwise interfere with seating of the next derelict product 16. The sweep 84 is synchronized with the ram 14 so as to operate in alternation with the ram 14. Sweeping follows cracking and can occur when the ram 14 reaches the far position or earlier or later, as necessary to meet other process requirements. The type of sweep 84 used is not critical.

FIGS. 1–5 illustrates an air sweep 84*a*, in which air or other pressurized gas is directed over the V-block 38 so as to blow the cracked derelict product 16 and any residual matter from the nest 12. Gas outlets (not shown) can blow from a position near or on the nest 12. The nest 12 shown in the figures has a plurality of gas passages 86 in the side support 46. The gas passages 86 connect to a plenum (not shown) which communicates with a pressurized gas supply (illustrated in FIG. 1 by a tank 88).

Figure 10:
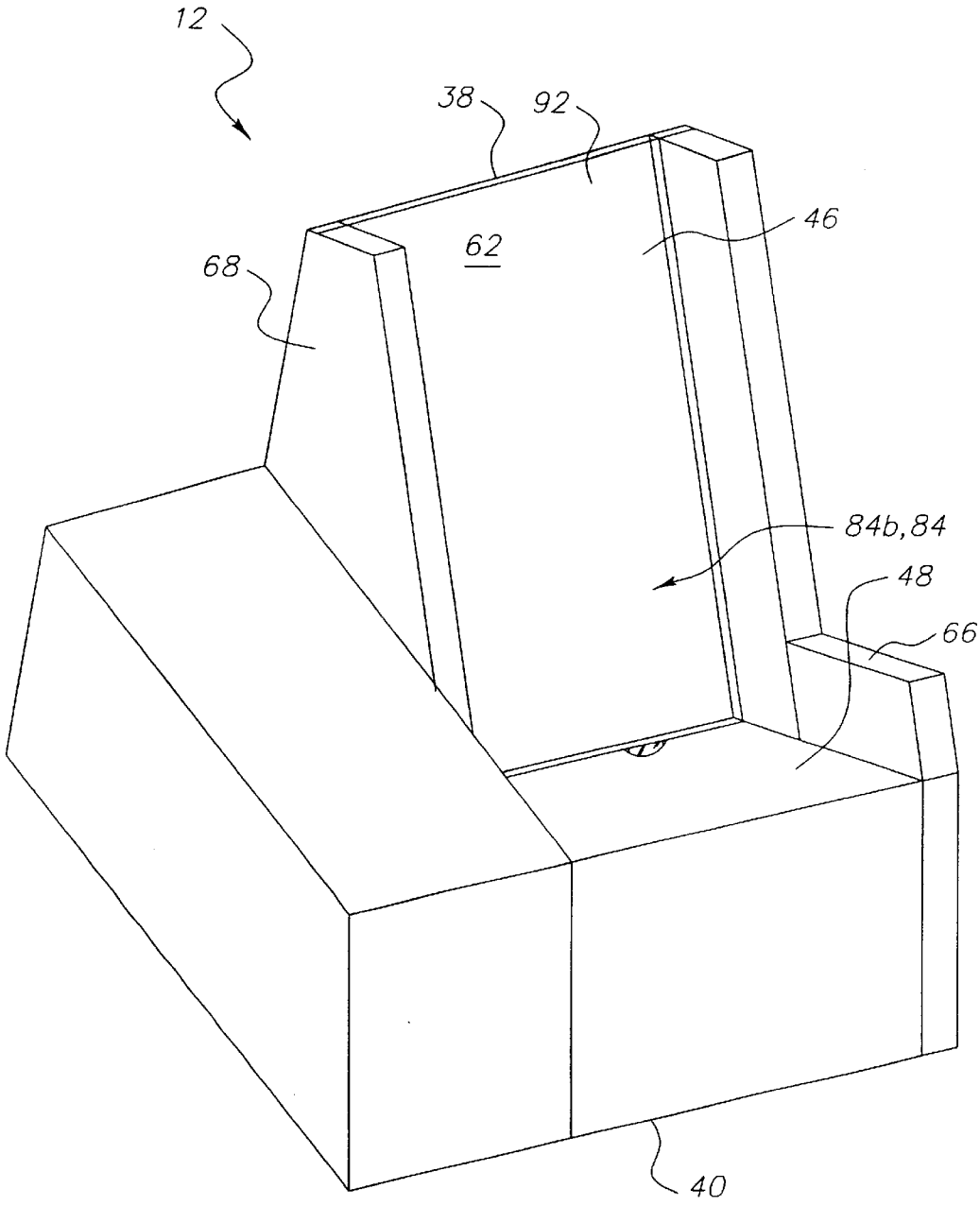
FIG. 10 is a perspective view of another embodiment of the nest. The flap is shown in the rest position.
Figure 11:
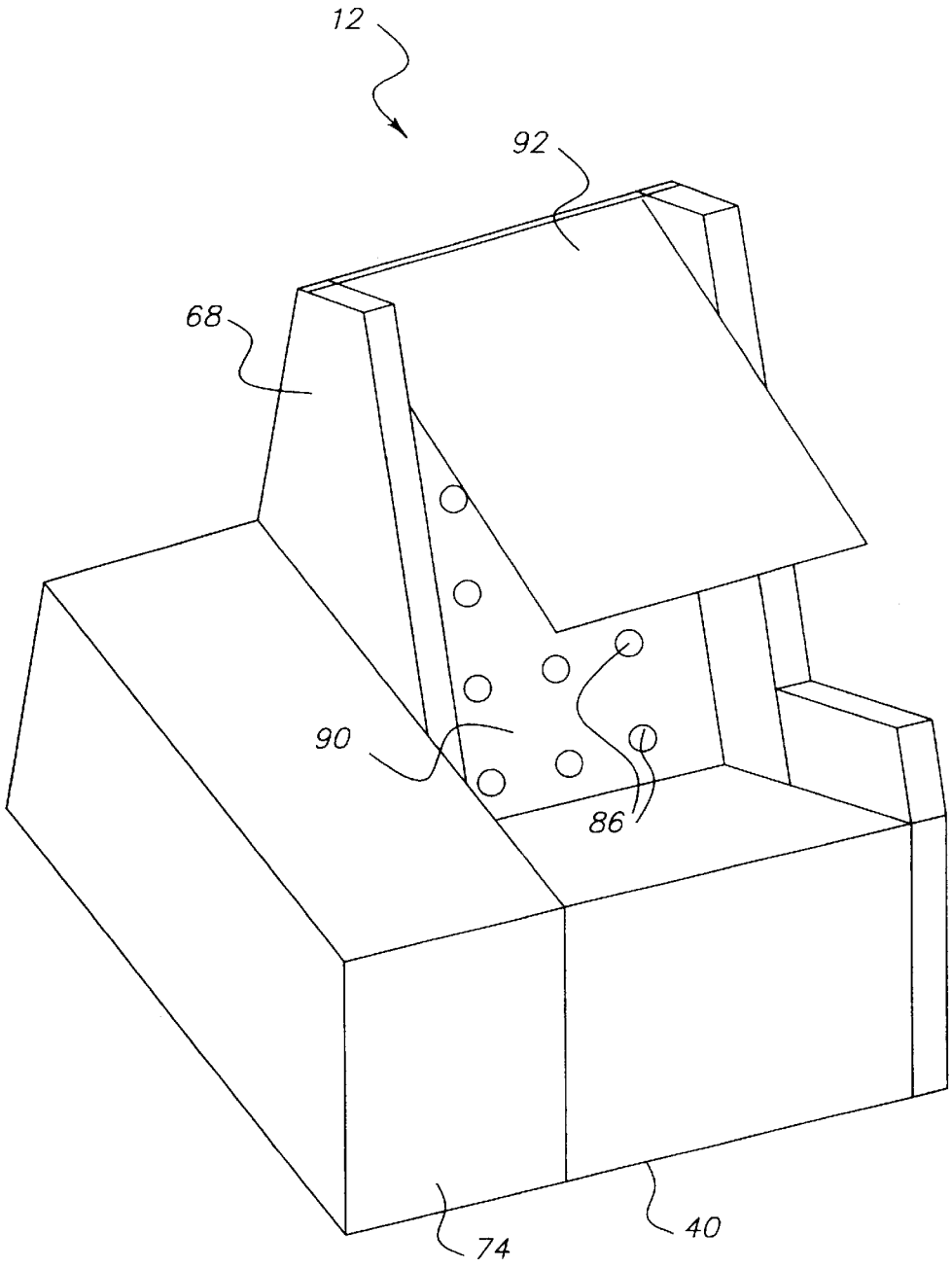
FIG. 11 is the same view as FIG. 10, but the flap is shown in the elevated position.

FIGS. 10–11 illustrate another sweep 84*b*. In this case, the side support 46 has a main portion 90 and a flap 92 overlying the main portion 90. The main portion 90 has gas passages 86 as in the cracker 10 of FIGS. 1–5. The flap 92 is imperforate and provides the surface 62 of the side support 46 contacted by the product 16 during cracking. The support surface 62 is inclined relative to the nest axis 42 and positioned relative to the end support 48 in the same manner as earlier discussed. The flap 92 is pivotably connected to the top of the side support 46 by a hinge (not shown). The flap 92 is freely movable between a rest position, shown in FIG. 10, in which the flap 92 is near and substantially parallel to the surface of the side support 46 and an elevated position, shown in FIG. 11, in which the flap 92 extends outward at an angle from the top of the side support 46. The pivoting of the flap 92 from the rest position to the elevated position drives a cracked derelict product 16 from the V-block 38. A blast of pressurized gas is expressed through the gas passages 86 of the side support 46 to provide the impetus to lift the flap 92.

The sweep 84 can be modified to pivot the flap 92 using a driver (not shown), such as a linear electric motor or an air cylinder or the like. The flap 92 can also be moved linearly along the surface of the end support 48 rather than pivoting, if desired.

Figure 7:
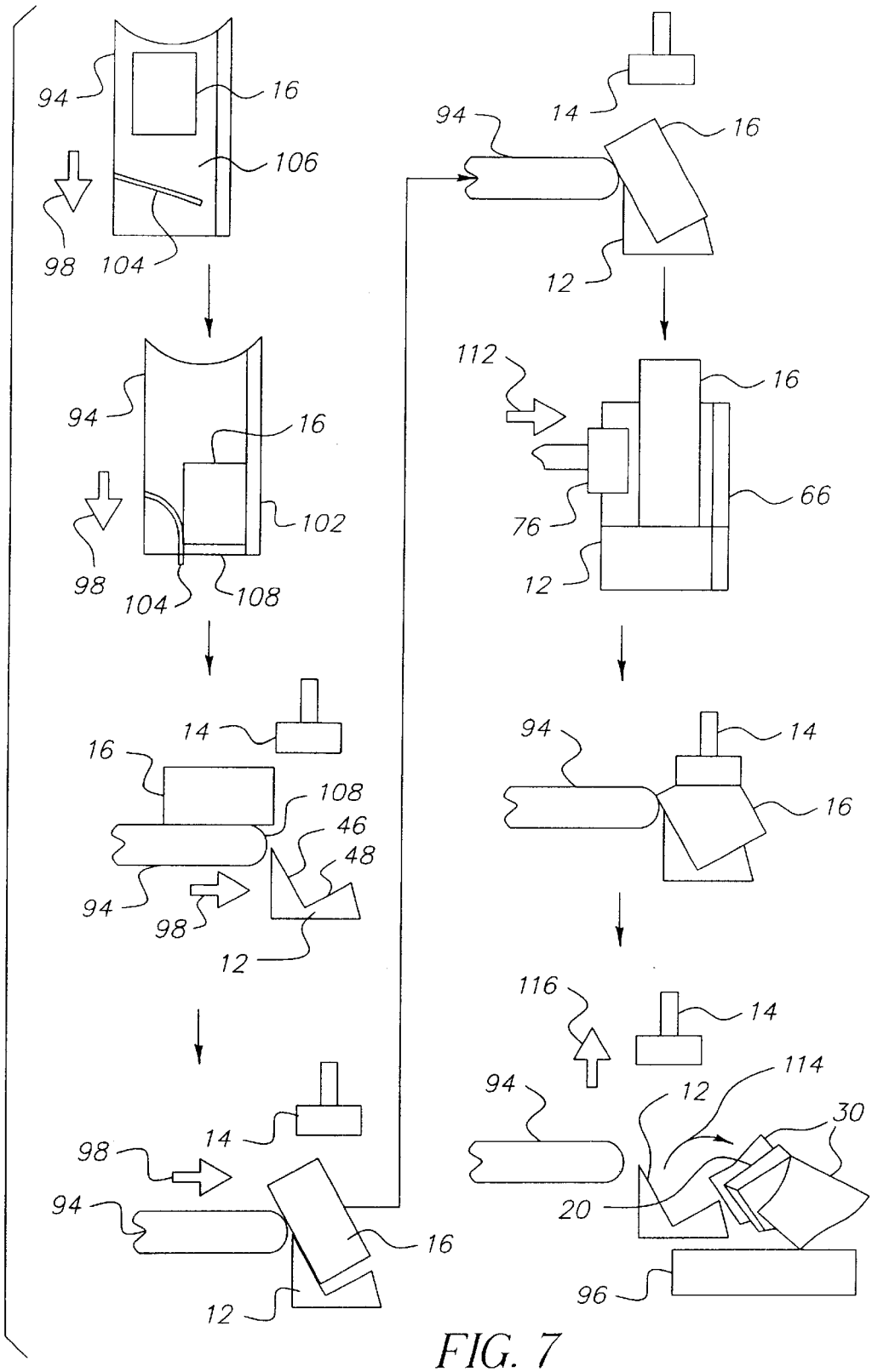
FIG. 7 is a diagram of an embodiment of the method.
Figure 8:
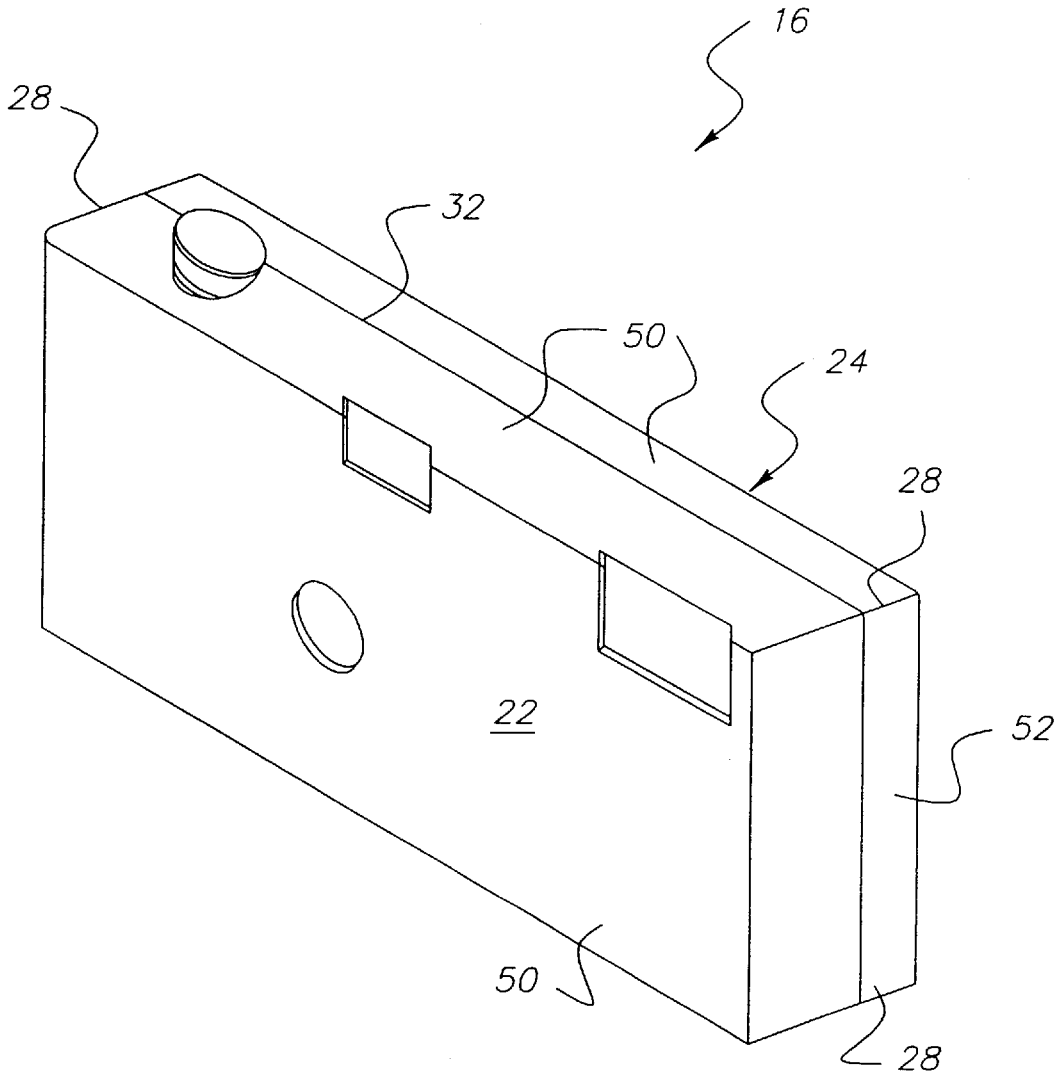
FIG. 8 is a semi-diagrammatical view of a one-time-use camera prior to cracking.

Referring now particularly to FIGS. 7 and 9, in the cracking method, derelict products 16 are transported to the nest 12 and placed in alignment in the nest 12. This alignment is maintained and the shell 18 is impacted at one of the corner-edges 28 with sufficient force to separate the covers 30 of the product 16. The covers 30 and core 20 are collected and transported away and the core 20 is sorted out.

The derelict products 16 are moved to the nest 12 on a first transporter 94 and are removed on a second transporter 96. The variety of types of transporter devices can be used. For example, a transporter can combine an immobile transport device (not shown), such as a chute; with a mobile device, such as a turntable or conveyor. In FIG. 7, the first and second transporters 94,96 are conveyors. The second transporter 96 is wide so as to accommodate scatter caused by the sweep 84. Manual efforts can be combined with automated transport in various ways, with the limitation that completely manual loading and unloading of the nest 12 is inefficient and unacceptable.

Derelict products 16 are seated in the nest 12 with diagonally opposed corner-edges 28 aligned with the nest axis 42. In the embodiments shown, the products 16 also have front and rear faces 22,24 aligned with the transverse axis 60 of the nest 12. The derelict products 16 are aligned during movement to the nest 12. The products 16 are placed on the first transporter 94 with front and rear faces 22,24 directed transverse to the direction of transport (indicated by arrow 98). With the conveyor shown, the products 16 are in an orientaion in which the faces 22,24 are directed toward the sides of the conveyor. This orientation parallels the transverse axis 60 in the embodiment shown in the figures, but may or may not in other embodiments. For example, the conveyor may curve before reaching the nest 12.

With one-time-use cameras, the rear faces 24 tend to be flatter than front faces 22 and, in many cases, the front faces 22 bulge outward at the taking lens (not shown). This presents a risk that the front face 22 of the camera could ride over the bumper 66 of the nest 12 and misalign the camera in the nest 12. This risk can be diminished by enlarging the bumper 66, or all of the cameras can all be oriented on the first transporter 94 in the same direction, with the rear faces 24 aligned so as to contact the bumper 66 when the cameras enter the nest 12. The former approach, enlarging the bumper 66, does not require orienting of the camera faces 22,24, but can increase the resistance of the cameras to cracking. The latter approach is particularly suitable if cameras are manually loaded on the first transporter 94 and then retained in the same front-to-rear orientation upon loading into the nest 12.

After reaching the end of the first transporter 94, the derelict products 16 are loaded into the nest 12, in alignment with the nest axis 42. The derelict products 16 can be placed in the nest 12 or can be impelled into the nest 12. Placement can use a pick-and-place device or other automated equipment. An impelling force can be provided by a linear driver, such as an air cylinder; but is conveniently provided by gravity. The impelling is preferably at a velocity insufficient to cause bouncing of the derelict product 16 in the nest 12, since such bouncing can easily result in misalignment. If the impelling force is gravity, then this adjustment is simply a matter of adjusting the distance of the derelict product 16 drops before being caught by the nest 12. If desired, derelict product 16 orientation on the first transporter 94 can be conserved during loading, whether the product 16 is placed or impelled.

For example, front-to-rear orientation of the product 16 is conserved by the gravity drop into the nest 12 shown in FIG. 7. A first transporter 94 is a conveyor that is positioned only slightly above the nest 12. The derelict product 16 travels on the belt of a conveyor.

Near the end of first transporter 94, a gate 100 opens and shuts as needed to deliver the products 16, one at a time. The gate 100 is illustrated as an air cylinder that has a piston that extends or retracts to block or permit passage of products 16. Other types of gate 100, such as a movable door can also be used. The gate 100 can be controlled manually or can be automated so as to synchronize with ram 14 and sweep 84 operation. Sensors (not shown) can monitor the gate 100 and other operations and automatic control of the gate 100 and other functions, using the sensors can be provided by a microprocessor or other controller (not shown). The first transporter 94 can also be synchronous, rather than asynchronous and can be synchronized with the operation of the ram 14. In this case, the gate 100 can be eliminated.

Following the gate 100, the products 16 are moved by an aligner 101 into alignment with the first bumper 66 of the nest 12. In the embodiments illustrated, the aligner 101 is a fence 102 and a resilient arm 104 and the products 16 are individually pushed against the fence 102 by the resilient arm 104 near the end of the first transporter 94. The arm 104 and fence 102 of the aligner 101 can be replaced by other structures that provide like positioning. For example, a second resilient arm (not shown) mirroring arm 104, can be used in place of the fence 102 or a pair of similarly shaped non-resilient guides (not shown) can be used.

At the end of the first transporter 94, the product 16 is impelled into the nest 12. In the embodiments shown in figures, transporter 94 is a conveyor and the product travels on a belt 106. When the product 16 reaches the return end 108 of the conveyor, the belt 106 curves back under and the derelict product 16 tips forward, and plunges off the belt and into the nest 12. The plunge is a tipping motion that moves a derelict product 16 that is resting on a longitudinal side 50, into an end 52 downward orientation. As the product 16 continues to tip, a corner-edge 28 strikes the side support 46, blocking further tipping. The product 16 then slides along the side support 46 until the end support 48 is reached and the product 16 lodges with opposed corner-edges 28 lined up with the nest axis 42.

In the embodiments shown in the figures, the nest 12 includes a clamp jaw 76 that is movable toward the bumper 66. The jaw 76 remains in a fully open position until the derelict product 16 is lodged in the V-block 38, then the clamp jaw 76 is moved (indicated by arrow 112 toward the bumper 66. Movement of the clamp jaw 76 continues until the shell 18 of the derelict product 16 is gripped between the the clamp jaw 76 and and the bumper 66. The clamp jaw 76 grips one of the faces 22,24, such as the front face of a one-time-use camera, and the bumper 66 grips the other face.

The derelict product 16 is impacted when the ram 14 moves from the far position to the near position. This movement takes the ram 14 into space that would otherwise be occupied by the derelict product 16. The near position of the ram 14 can be adjusted, if the product stream can be well predicted, to enter the space occupied by the shell 18 but to not enter the space occupied by the core 20. This reduces risk of damage to the core 20.

The ram 14 does not contact the nest 12 and, in the illustrated embodiments, does not closely approach the end support 48. The impact occurs on the uppermost portion of the derelict product 16, which is a corner-edge 28. While the impacting is occurring, the V-block 38 is directly supporting the shell 18 in the vicinity of the diagonally opposite corner-edge 28. The product 16 is held in alignment with the nest 12 and transverse axes. The nest axis 42 extends through both corner-edges 28. The transverse axis 60 is parallel to the transverse dimension defined by the corner-edges 28.

As earlier noted, the force of the impact on the derelict product 16 is sufficient to separate the covers 30 from each other end, in some cases, from the core 20. The force of the impact can be set so as to minimally accommodate the most cracking resistant product of an expected stream of derelict products 16. Alternatively, a lower force can be set, based upon an assumption that some products 16 would require multiple impacts. This further assumes automated or manual recracking of more resistant products 16.

Following impacting, the ram 14 is returned in the opposite direction toward the far position as indicated by arrow 116. In the illustrated embodiments, the sweep 84 is actuated following cracking to sweep the covers 30 and core 20 of the cracked product 16 off the V-block 38 and onto the second transporter 96 as indicated by arrow 114. Sweeping may not always be necessary. In some cases, the cracked derelict product 16 may fall out of the nest 12 onto the second transporter 96. In other cases, separated parts of a product 16 may remain on the nest 12 and other parts fall onto the second transporter 96. Sweeping ensures that the covers 30 and core 20 reach the second transporter 96 and that the nest 12 is cleared of any residual parts or fragments. In the illustrated embodiments, sweeping is in a direction that is away from both the nest axis 42 and the transverse axis 60.

After cracking, the covers 30 and core 20 are collected and classified so as to sort out the cores 20 from the shells 18. Collecting can be limited to catching swept or fallen parts on the second transporter 96 or can include additional procedures. The manner of classifying is not critical. Classification can be manual or automated or a combination of the two. For example, the second transporter 96 can fill bins, which are then dumped and parts are manually sorted into two or more categories. (This is indicated schematically in FIG. 9 by boxes 110.)

The methods and apparatus have been described primarily in relation to derelict products 16 in the form of one-time-use cameras. Like considerations apply other derelict products 16. Each cracker 10 is limited to products 16 of particular range of sizes and resistances to cracking; but, within those limitations, the types of product 16 cracked can be varied as desired. Cracker 10 characteristics can be rescaled proportionately for products 16 of larger or smaller ranges of size or greater or lesser resistance to cracking.

The invention has been described in detail with particular reference to certain preferred embodiments thereof, but it will be understood that variations and modifications can be effected within the spirit and scope of the invention.

What is claimed is:

1. A method of cracking a derelict product having a shell covering a core, said shell having opposed front and rear faces and a sidewall extending between said faces, said sidewall having at least one pair of diagonally opposed corner-edges extending transversely between said faces, said shell being separable along said sidewall into a pair of covers, each said cover including one of said faces and a part of said sidewall, said method comprising:

placing said derelict product into a nest such that said pair of diagonally opposed corner-edges of said sidewall are in alignment with an axis of said nest;

following said placing, impacting said shell at one corner-edge of said pair of diagonally opposed corner-edges with sufficient force to separate said covers;

maintaining said alignment with said nest axis during said impacting;

collecting said covers and said core; and sorting out said core.

2. The method of claim 1 further comprising:

aligning said front and rear faces with a transverse axis prior to said placing, said transverse axis being perpendicular to said nest axis; and maintaining said alignment with said transverse axis during said impacting.

3. The method of claim 1 further comprising sweeping has been inserted between in a direction away from said axis following said impacting.

4. The method of claim 1 further comprising, during said impacting, directly supporting said shell near one corner-edge of said pair of diagonally opposed corner-edges.

5. The method of claim 1 further comprising impelling said derelict product into said alignment with said nest axis.

6. The method of claim 5 wherein said impelling further comprises dropping said derelict product and, following said dropping, catching said derelict product in said nest; wherein said nest is an inclined nest.

7. The method of claim 5 wherein said impelling is at a velocity insufficient to cause bouncing of said derelict product.

8. The method of claim 1 further comprising, during said impacting, gripping said faces of said shell.

9. The method of claim 1 wherein said core is a circuit board.

10. The method of claim 1 wherein said sorting follows said collecting.

11. A method of cracking a derelict product having a shell covering a core, said shell having opposed front and rear faces and a sidewall extending between said faces, said sidewall having at least one pair of diagonally opposed corner-edges extending transversely between said faces, said shell being separable along said sidewall into a pair of covers, each said cover including one of said faces and a part of said sidewall, said method comprising:

loading said derelict product on a transporter; during said loading, setting said faces in an orientation transverse to a transport direction of said transporter;

impelling said derelict product into a nest;

during said dropping, maintaining said transverse orientation;

impacting said shell at one of said corner-edges with sufficient force to separate said covers;

supporting another, diagonally opposed one of said corner-edges in said nest during said impacting;

sweeping said nest clear of said derelict product following said impacting.

12. The method of claim 11 wherein said corner-edges define a nest axis following said impelling and said method further comprises, during said impacting, holding said derelict product in alignment with a transverse axis perpendicular to said nest axis.

13. The method of claim 11 wherein said sweeping is in a direction outward from said nest and transverse axes.

14. The method of claim 11 wherein said impelling further comprises dropping said derelict product at a maximum velocity insufficient to cause bouncing of said derelict product in said nest.

* * * * *